US008634745B2

(12) United States Patent
Tomatsu

(10) Patent No.: US 8,634,745 B2
(45) Date of Patent: Jan. 21, 2014

(54) COVER OPENING AND CLOSING MECHANISM AND IMAGE PROCESSING DEVICE

(75) Inventor: Yoshiya Tomatsu, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 124 days.

(21) Appl. No.: 13/075,985

(22) Filed: Mar. 30, 2011

(65) Prior Publication Data

US 2011/0318050 A1 Dec. 29, 2011

(30) Foreign Application Priority Data

Jun. 29, 2010 (JP) ..... 2010-147757

(51) Int. Cl.
*G03G 15/00* (2006.01)

(52) U.S. Cl.
USPC ..... 399/110; 399/114

(58) Field of Classification Search
USPC ..... 399/110; 292/340, 3.7, 32, 269; 220/3.7, 324, 291, 292; 411/145; 75/450; 70/69, 38 R; 206/373, 749, 206/755, 759, 557, 405, 831; 150/154; 49/186, 159
See application file for complete search history.

(56) References Cited

U.S. PATENT DOCUMENTS

| | | | | |
|---|---|---|---|---|
| 4,746,008 | A * | 5/1988 | Heverly et al. | 206/1.5 |
| 6,633,414 | B1 | 10/2003 | Matsuda et al. | |
| 7,029,006 | B2 * | 4/2006 | Izumi et al. | 271/145 |
| 2007/0138193 | A1 * | 6/2007 | Aono et al. | 220/810 |

FOREIGN PATENT DOCUMENTS

| | | | | |
|---|---|---|---|---|
| JP | 2000-022868 | | 1/2000 | |
| JP | 2000-039827 | | 2/2000 | |
| JP | 2000-098681 | | 4/2000 | |
| JP | 2000-098681 | A * | 4/2000 | G03G 15/00 |
| JP | 2000-098861 | | 4/2000 | |
| JP | 2000098681 | A * | 7/2000 | |
| JP | 2006-030219 | | 2/2006 | |

OTHER PUBLICATIONS

CN Office Action mailed Sep. 23, 2013, CN app 201110090001.6, English translation.

* cited by examiner

*Primary Examiner* — Clayton E Laballe
*Assistant Examiner* — Jas Sanghera
(74) *Attorney, Agent, or Firm* — Banner & Witcoff, Ltd.

(57) ABSTRACT

A cover opening and closing mechanism, including: a housing; a cover; a first locking mechanism having a first stopper portion and a first receiving portion which are brought to a locked state when the cover is in the closed position; and a second locking mechanism having a second stopper portion and a second receiving portion which are brought to a locked state when the cover is in the closed position, and wherein, when the cover is moved to the closed position, the first stopper portion and the first receiving portion move with respect to each other in a first direction, move with respect to each other in a second direction, and thereafter are brought to the locked state, and the second stopper portion moves in the second direction in connection with movement of the first stopper portion so that the second locking mechanism is brought to the locked state.

14 Claims, 10 Drawing Sheets

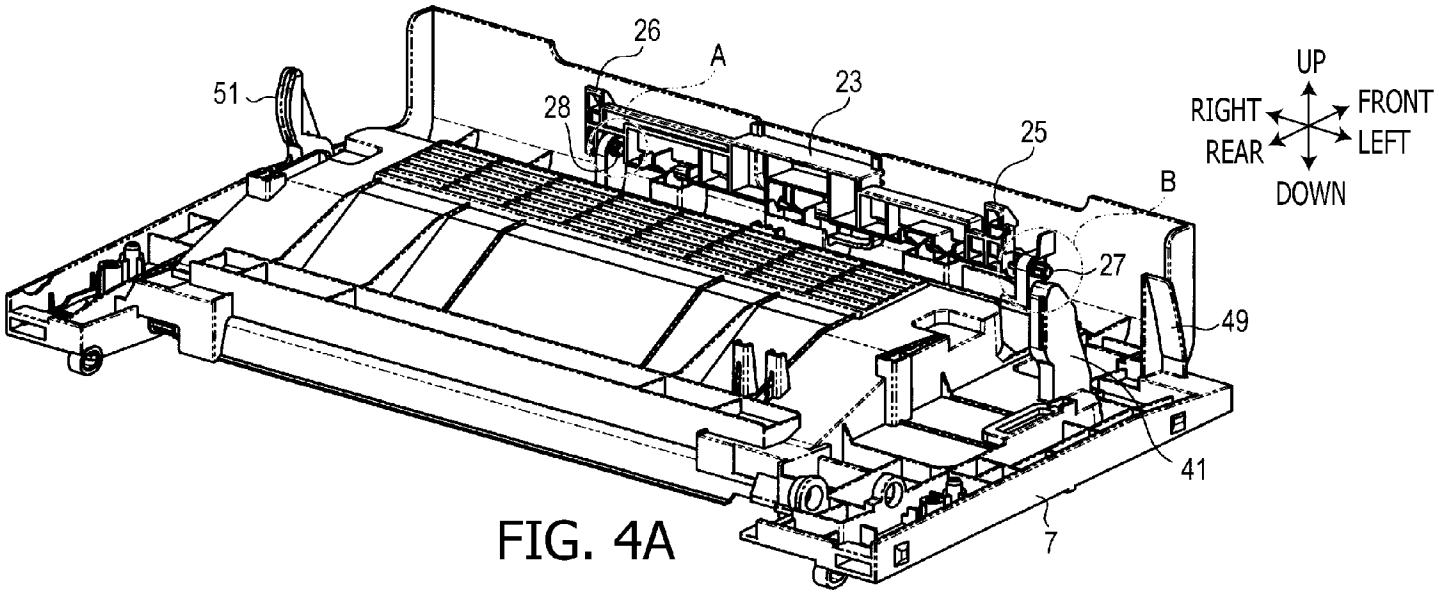
FIG. 4A
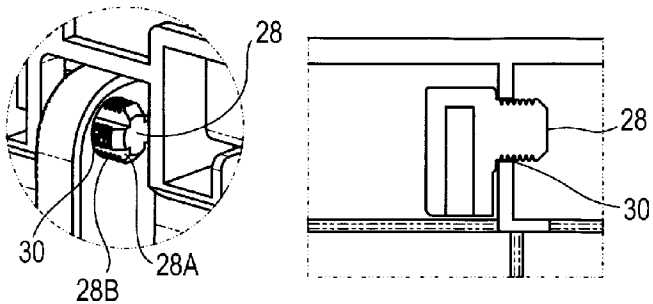
FIG. 4B
FIG. 4C
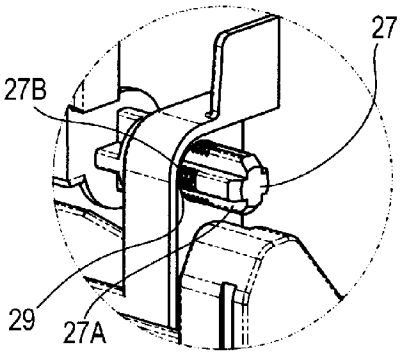
FIG. 4D
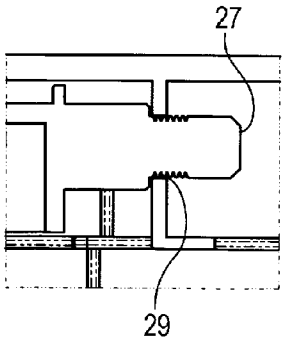
FIG. 4E

COVER OPENING AND CLOSING MECHANISM AND IMAGE PROCESSING DEVICE

CROSS-REFERENCE TO RELATED APPLICATION

This application claims priority under 35 U.S.C. §119 from Japanese Patent Application No. 2010-147757, filed on Jun. 29, 2010. The entire subject matter of the application is incorporated herein by reference.

BACKGROUND

1. Technical Field

Aspects of the present invention relate to a cover opening and closing mechanism configured to open and close a cover for covering an opening formed in a housing, and to an image processing device provided with such a cover opening and closing mechanism.

2. Related Art

Conventionally, an image forming device having a cover opening and closing mechanism capable of opening and closing a cover for covering an opening formed in a housing of the image forming device has been used.

SUMMARY

However, there is a possibility that, if the degree of rigidity of the cover is low and the cover could be deformed when receiving an external force, a drawing force for drawing the cover toward a closed position is weakened and thereby the cover may be closed in a one-sided closed state.

If a sensor for detecting whether the cover is closed is located at a position shifted closer to one of the pair of locking mechanism with respect to the center of the pair of locking mechanisms, the sensor may erroneously detect the state of the cover.

Aspects of the present invention are advantageous in that they provide at least one of a cover opening and closing mechanism and an image processing device configured to prevent a cover from being closed in a one-sided closed state, and to properly detect whether the cover is closed or opened even when a sensor for detecting the state of the cover is located as a position shifted closer to one of a pair of locking mechanisms.

According to an aspect of the invention, there is provided a cover opening and closing mechanism, comprising: a housing having an opening; a cover that is attached to the housing to be rotatable about a predetermined rotation axis so that the cover is movable between a closed position and an opened position; a first locking mechanism having a first stopper portion provided at one of a first position on the cover and a corresponding position on the housing and a first receiving portion provided at the other of the first position on the cover and the corresponding position on the housing, the first stopper portion and the first receiving portion being brought to a locked state when the cover is in the closed position; and a second locking mechanism having a second stopper portion provided at one of a second position on the cover and a corresponding position on the housing and a second receiving portion provided at the other of the second position on the cover and the corresponding position on the housing, the second stopper portion and the second receiving portion being brought to a locked state when the cover is in the closed position. In this configuration, when the cover is moved to the closed position, the first stopper portion and the first receiving portion move with respect to each other in a first direction and contact with each other, and then move with respect to each other in a second direction intersecting with the first direction, and thereafter the first stopper portion and the first receiving portion are brought to the locked state after the first stopper portion passes over the first receiving portion. The second locking mechanism is configured such that the second stopper portion moves in the second direction in connection with movement of the first stopper portion in the second direction so that the second stopper portion and the second receiving portion are brought to the locked state when the first stopper portion and the first receiving portion are brought to the locked state.

According to another aspect of the invention, there is provided an image processing device, comprising: an image processing unit and the above described cover opening and closing mechanism.

BRIEF DESCRIPTION OF THE ACCOMPANYING DRAWINGS

FIG. 4A is a perspective view illustrating only the front cover situated in the opened position, FIG. 4B is an enlarged view of a portion A in FIG. 4A, FIG. 4C is a cross sectional view of a portion around a support shaft of the open button on the right edge side, FIG. 4D is an enlarged view of a portion B in FIG. 4A, and FIG. 4E is a cross section of a portion around the support shaft at the left edge side.

Figure 5A:
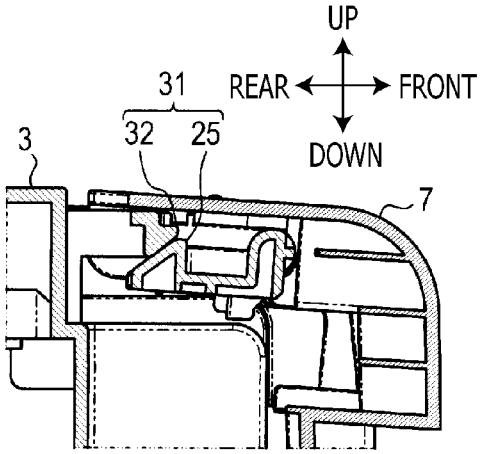
Figure 5B:
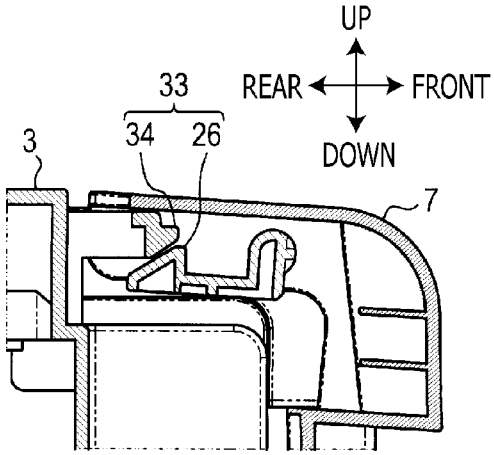
Figure 5C:
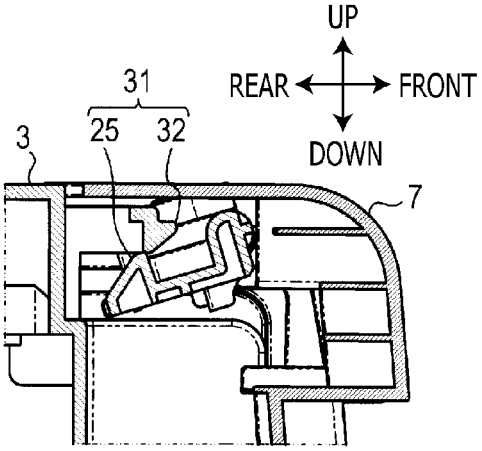
Figure 5D:
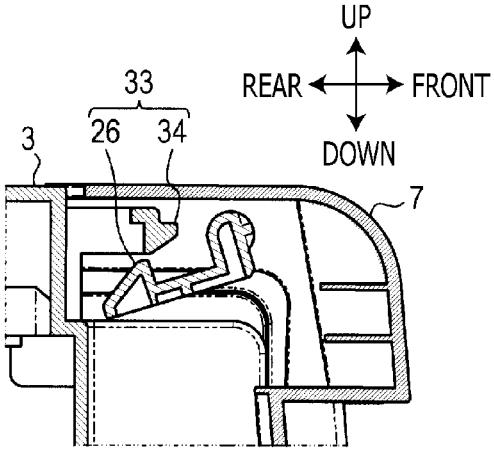
Figure 5E:
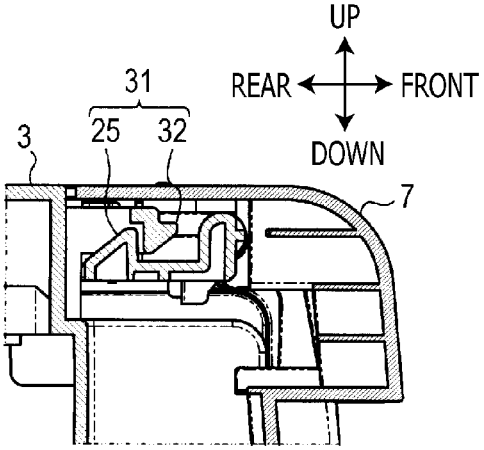
Figure 5F:
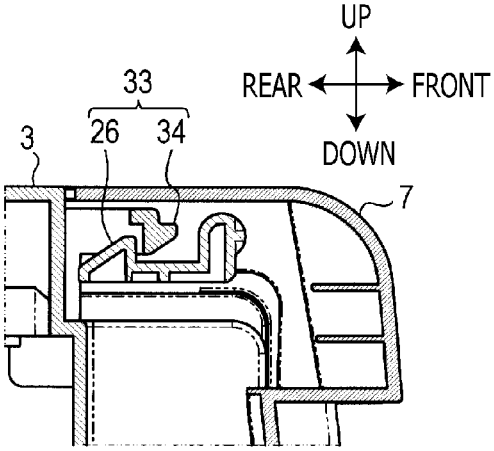

FIG. 5A is a left side vertical cross section illustrating a situation where a stopper portion and a receiving portion of a first locking mechanism contact with each other, FIG. 5B is a left side vertical cross section illustrating positions of a stopper portion and a receiving portion of a second locking mechanism defined when the first locking mechanism in the state of FIG. 5A, FIG. 5C is a left side vertical cross section illustrating a situation where the stopper portion of the first locking mechanism rotates and passes over the receiving portion of the first locking mechanism, FIG. 5D is a left side vertical cross section illustrating the stopper portion and the receiving portion of the second locking mechanism defined when the first locking mechanism is in the state shown in FIG. 5C, FIG. 5E is a left side vertical cross section illustrating a situation where the stopper portion engages with the receiving portion in the first locking mechanism, and FIG. 5F is a left side vertical cross section illustrating the stopper portion and the receiving portion of the second locking mechanism defined when the first locking mechanism is in the state shown in FIG. 5E.

Figure 6A:
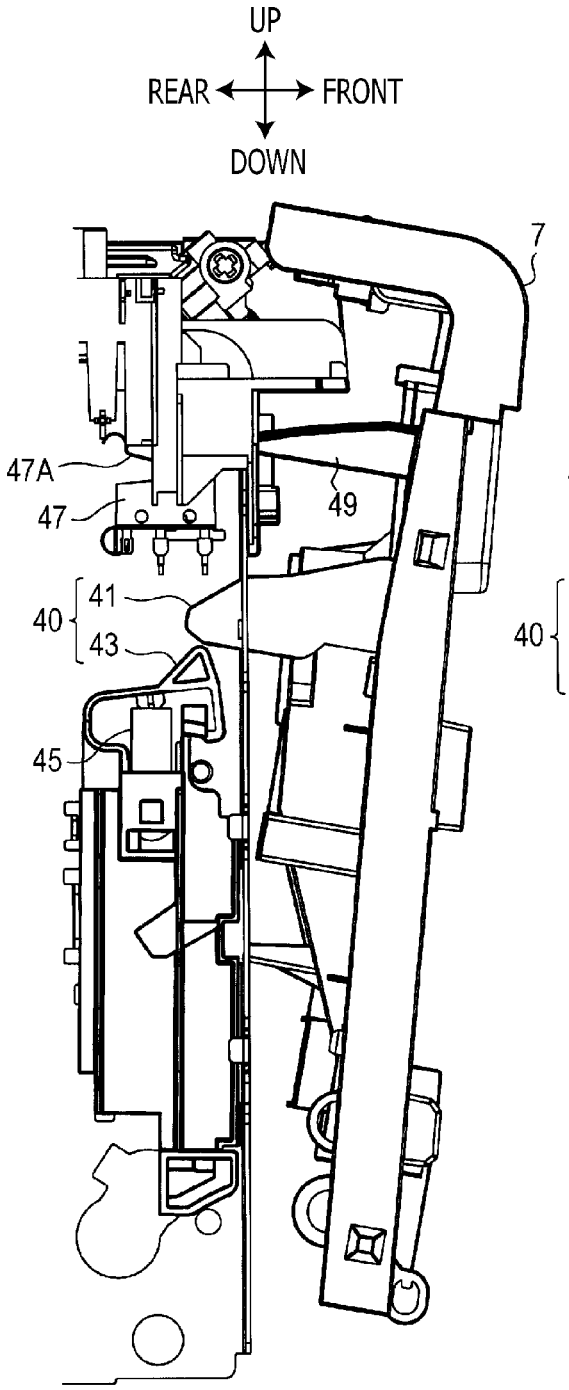
Figure 6B:
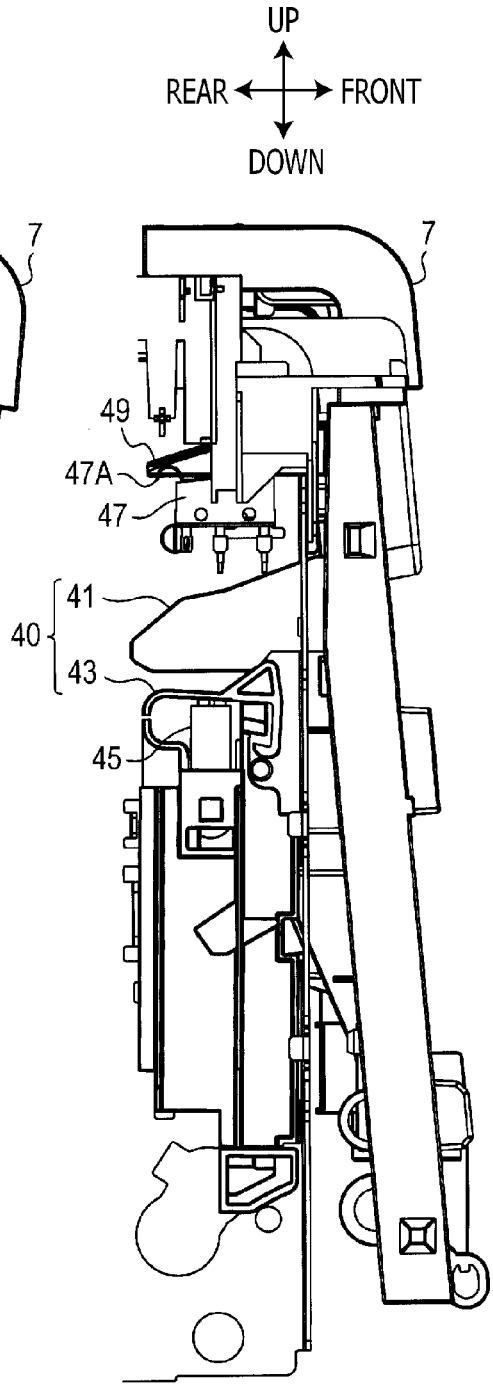

FIGS. 6A and 6B illustrate left side vertical cross section for explaining a third locking mechanism, and in FIG. 6A a situation where the front cover is moved slightly from the closed position to the opened position is illustrated, and in FIG. 6B a situation where the front cover is in the closed position is illustrated.

Figure 7A:
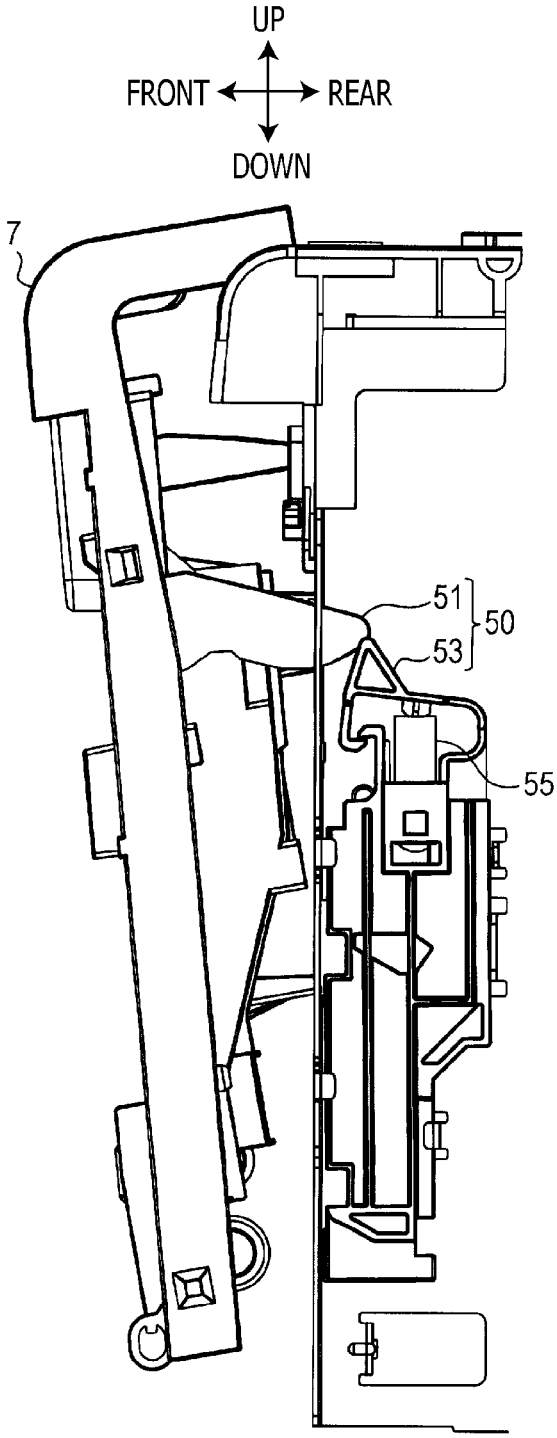
Figure 7B:
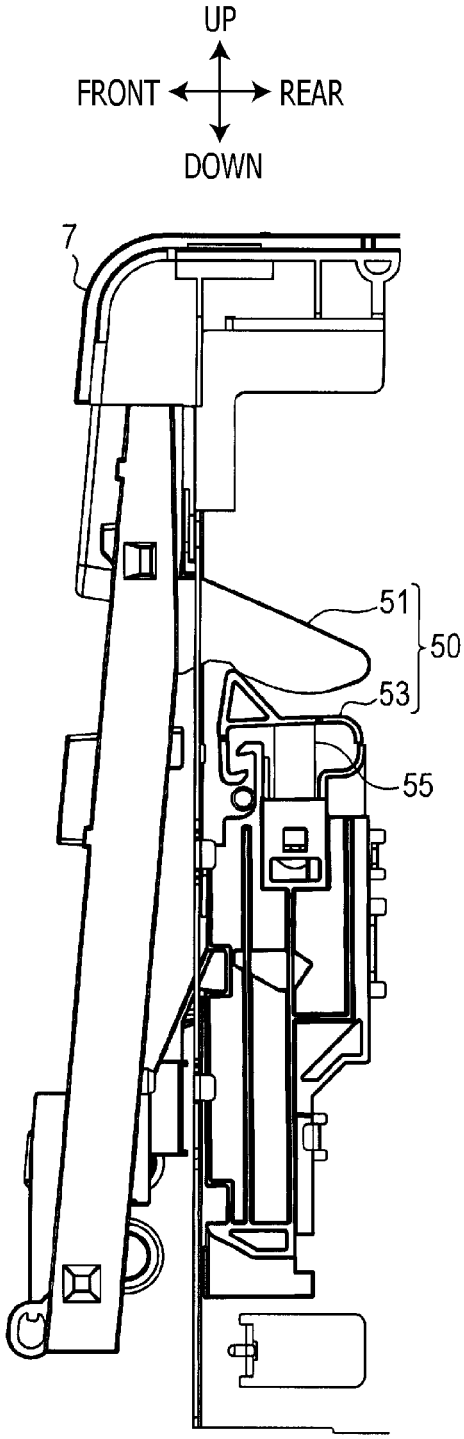

FIGS. 7A and 7B illustrate right side cross sections for explaining a fourth locking mechanism, and in FIG. 7A a situation where the front cover is slightly moved from the closed position to the opened position is illustrated, and in FIG. 7B a situation where the front cover is in the closed position is illustrated.

Figure 8A:
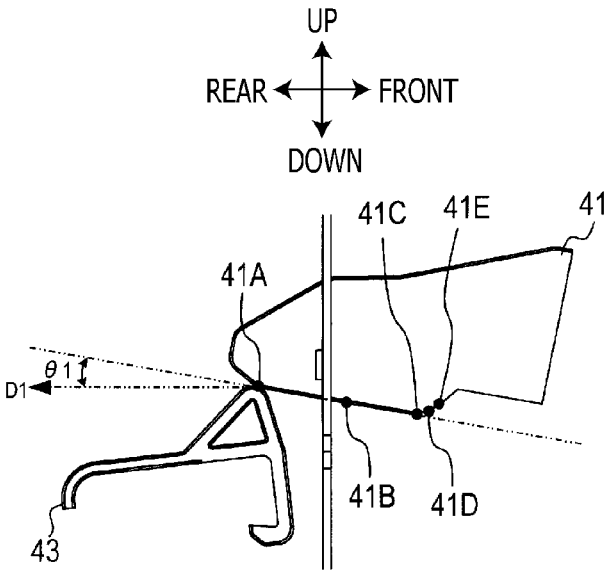
Figure 8B:
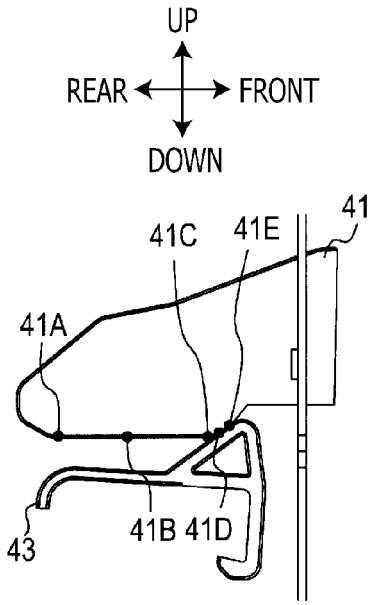
Figure 8C:
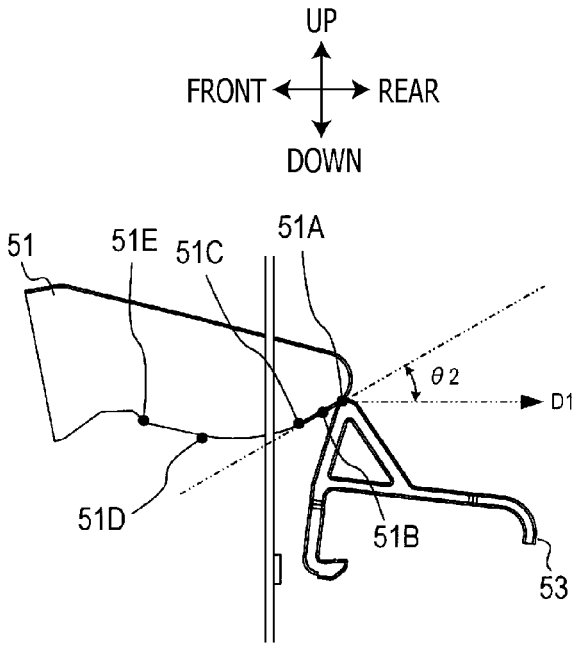
Figure 8D:
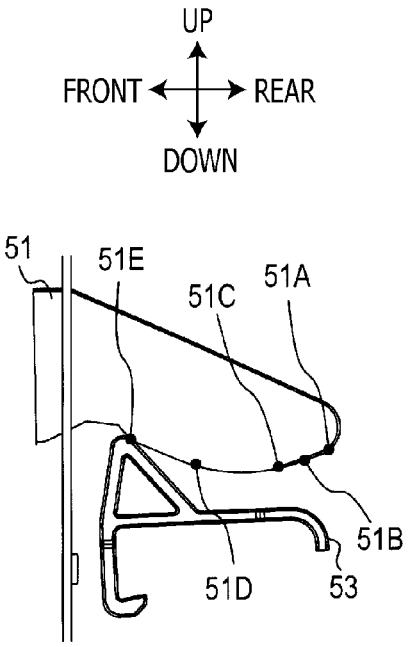

FIG. 8A is a left side view illustrating a situation where a stopper portion contacts a receiving portion in the third locking mechanism, FIG. 8B is a left side view illustrating a situation where the stopper portion engages with the receiving portion in the third locking mechanism, FIG. 8C is a right side view illustrating a situation where a stopper portion and a receiving portion in the fourth locking mechanism contact with each other, and FIG. 8D is a right side view illustrating a situation where the stopper portion engages with the receiving portion in the fourth locking mechanism.

Figure 9:
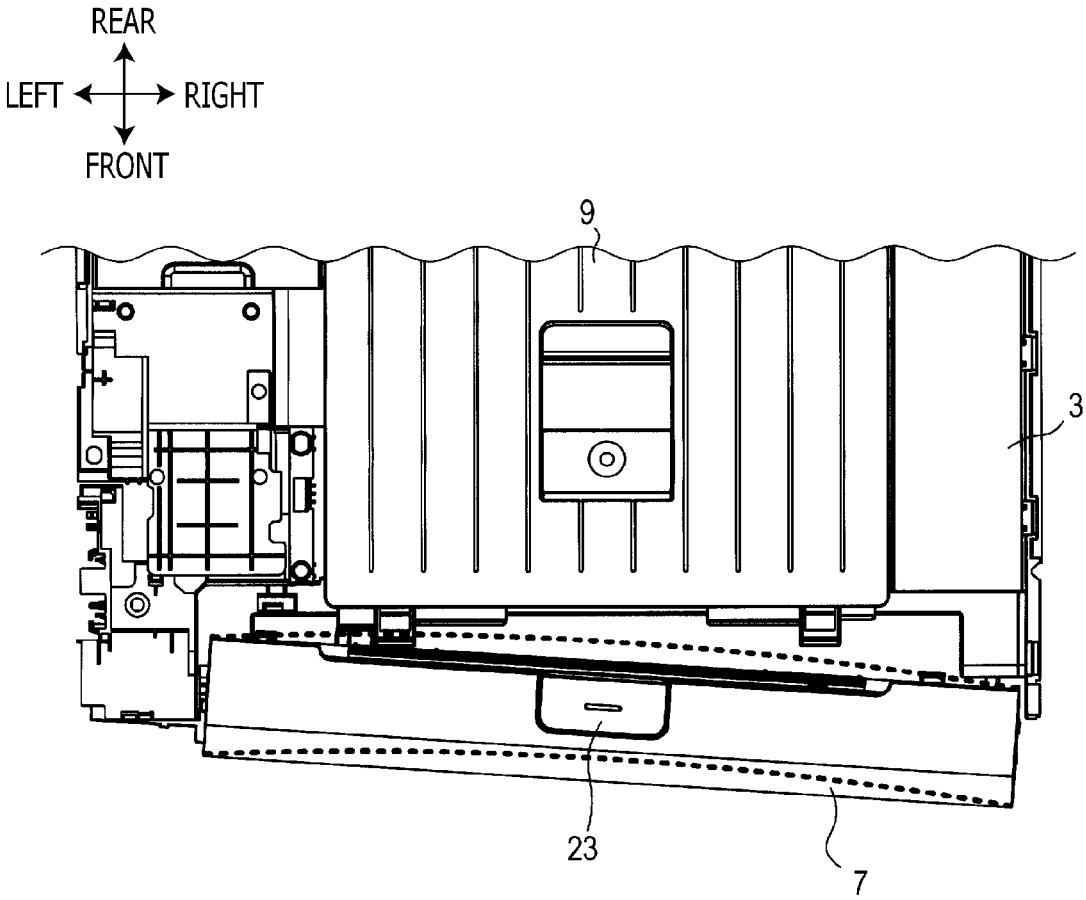

FIG. 9 is an explanatory illustration for explaining deformation caused in the front cover when the left edge part of the front cover is pressed.

Figure 10A:
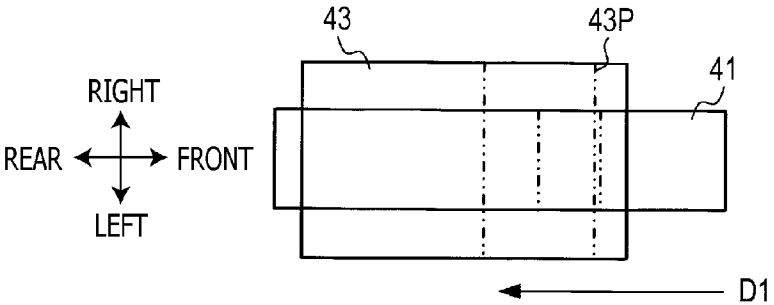
Figure 10B:
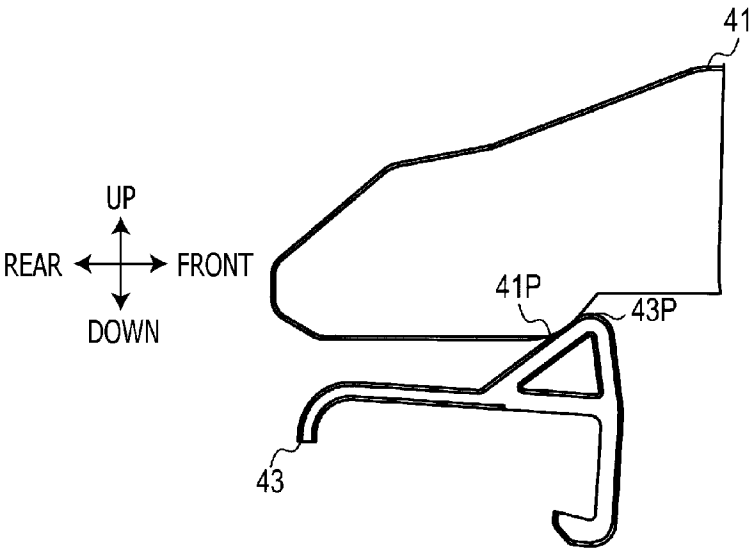
Figure 10C:
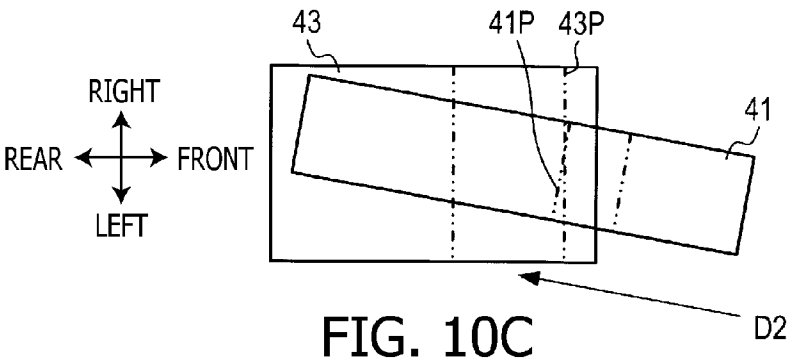
Figure 10D:
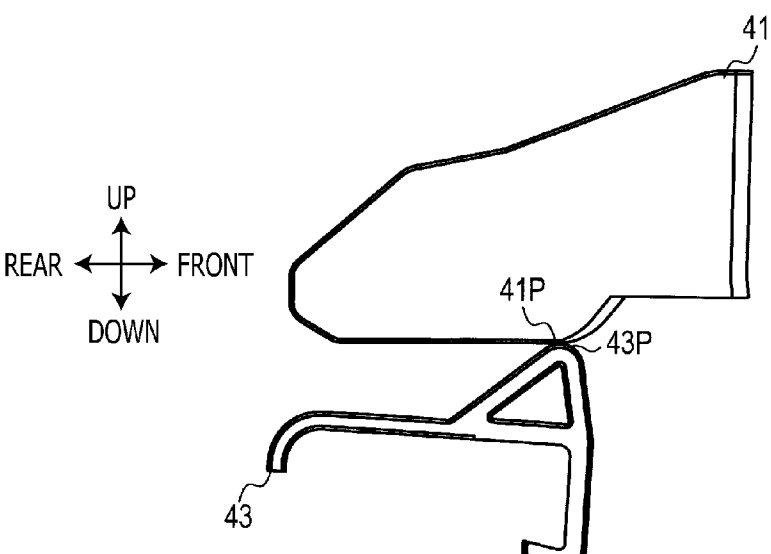

FIG. 10A is a plan view illustrating a situation where the stopper portion and the receiving portion of the third locking mechanism properly engage with each other, FIG. 10B is a left side view illustrating a situation where the stopper portion and the receiving portion of the third locking mechanism properly engage with each other, FIG. 10C is a plan view illustrating a situation where the stopper portion and the receiving portion of the third locking member are not able to engage with each other, and FIG. 10D is a left side cross section where the stopper portion and the receiving portion of the third locking member are not able to engage with each other.

DETAILED DESCRIPTION

Hereafter, an embodiment according to the invention will be described with reference to the accompanying drawings. In the following, positional relationships between components are explained while referring to upward, downward, leftward, rightward, front and rear directions indicated in the drawings.

Figure 1:
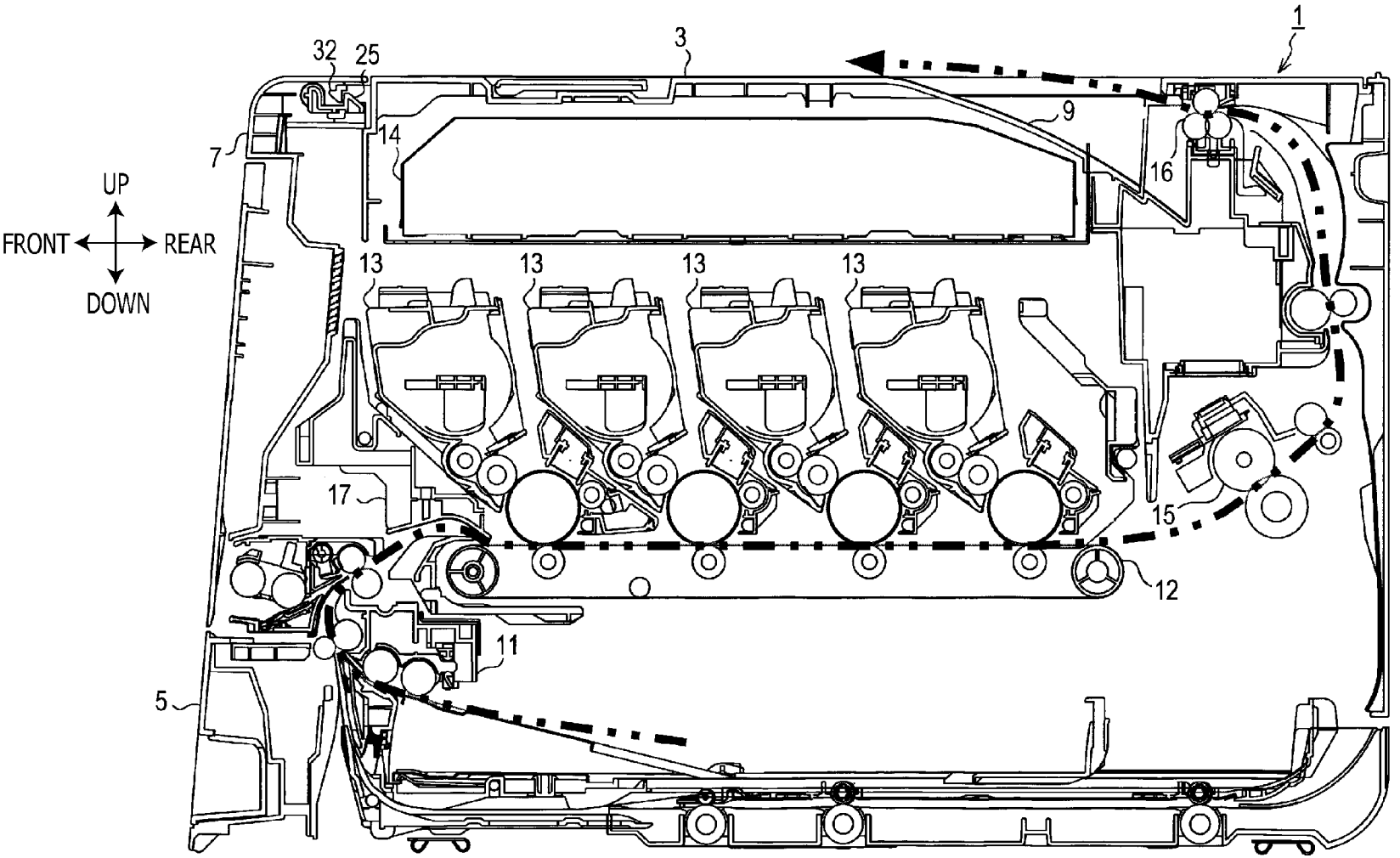
FIG. 1 is a vertical cross section illustrating an inner structure of an image forming device according to an embodiment.

As shown in FIG. 1, an image forming device 1 includes a pullout paper cassette 5 at a lower front part of a housing 3. On the front side of the housing 3, a front cover 7 is provided above the paper cassette 5. The front cover 7 is attached to the housing 3 to be rotatable about a rotation axis situated at a lower side of the front cover 7 so that an upper side of the front cover 7 can be inclined frontward with respect to the rotation axis. On the top surface of the housing 3, an output tray 9 is provided. The recording medium on which an image has been formed is ejected is to the output tray 9.

Figure 2:
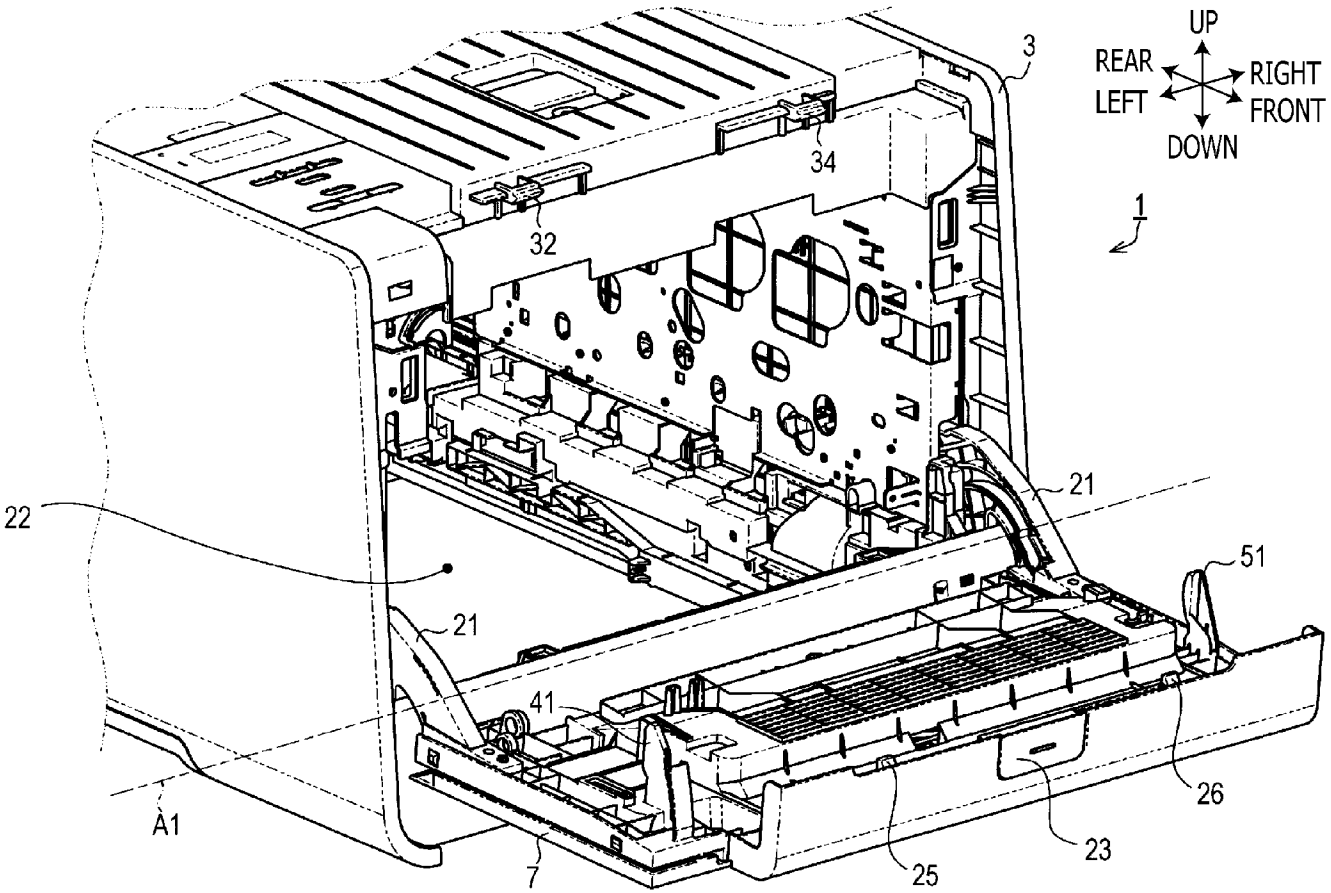
FIG. 2 is a partial perspective view illustrating a front cover situated in an opened position and components around the front cover.

As shown in FIG. 2, the image forming device 1 is formed as a device having a tandem type image formation mechanism capable of forming an image through an electrophotographic process. The image forming device 1 includes a paper supply unit 11, a belt unit 12, process cartridges 13, a scanning unit 14, a fixing unit 15, an ejection unit 16 and a drawer 17.

The paper supply unit 11 sends out a sheet-like recording medium (e.g., a sheet of paper) accommodated in the paper cassette 5 toward the downstream side along a paper carrying path (indicated by a double chain line in FIG. 1).

The belt unit 12 carries the recording medium sent out by the paper supply unit 11 from the front side to the rear side while sandwiching the recording medium between the belt unit 12 and the process cartridges 13. The four process cartridges 13 are arranged in equal intervals above the belt unit 12. Each process cartridge 13 includes a photosensitive body and a developing mechanism which develops an electrostatic latent image formed on the photosensitive body.

The scanning unit 14 emits a laser beam toward the photosensitive body of each process cartridge 13 so as to form an electrostatic latent image on the photosensitive body. The electrostatic latent image formed on the photosensitive body by the scanning unit 14 is developed as a toner image by the developing mechanism provided in the process cartridge 13. Then, the toner image is transferred to the recording medium on the belt unit 12.

The fixing unit 15 fixes the toner image on the recording medium by heating and pressing the recoding medium on which the toner image has been transferred, while sandwiching the recording medium between rollers of the fixing unit 15. The recording medium which has passed the fixing unit 15 is then ejected to the output tray 9 through the ejection unit 16.

The drawer 17 is configured to be pulled out toward the front side in the state where the front cover 7 is opened. On the drawer 17, the process cartridges 13 are mounted so that the process cartridges 13 can be changed by pulling out the drawer 17.

Hereafter, a locking mechanism which is brought to a locked state when the front cover 7 is moved to a closed position is explained.

As shown in FIG. 2, the front cover 7 is arranged such that the front cover 7 rotates about a rotation center (i.e., a rotation axis A1) defined at a lower edge portion thereof so that the front cover 7 can be inclined frontward. More specifically, an arm 21 capable of rotating about the rotation axis A1 which is parallel with the lower edge or the upper edge of the opening 22 situated on the front face of the housing 3 is provided at a front lower portion of the housing 3. The front cover 7 is fixed to the tip of the arm 21.

Since the front cover 7 rotates together with the arm 21, the front cover 7 is able to rotate between the closed position shown in FIG. 1 and an opened position shown in FIG. 2. When the front cover 7 is in the opened position, the drawer 17 can be drawn through the opening 22. It should be noted that the rotation axis A1 may not be completely parallel with the upper edge or the lower edge of the opening 24. For example, the rotation axis A1 may be slightly inclined with respect to the upper edge or the lower edge of the opening 24. That is, the rotation axis A1 may be arranged to be substantially parallel with the upper edge or the lower edge of the opening 24.

Figure 3:
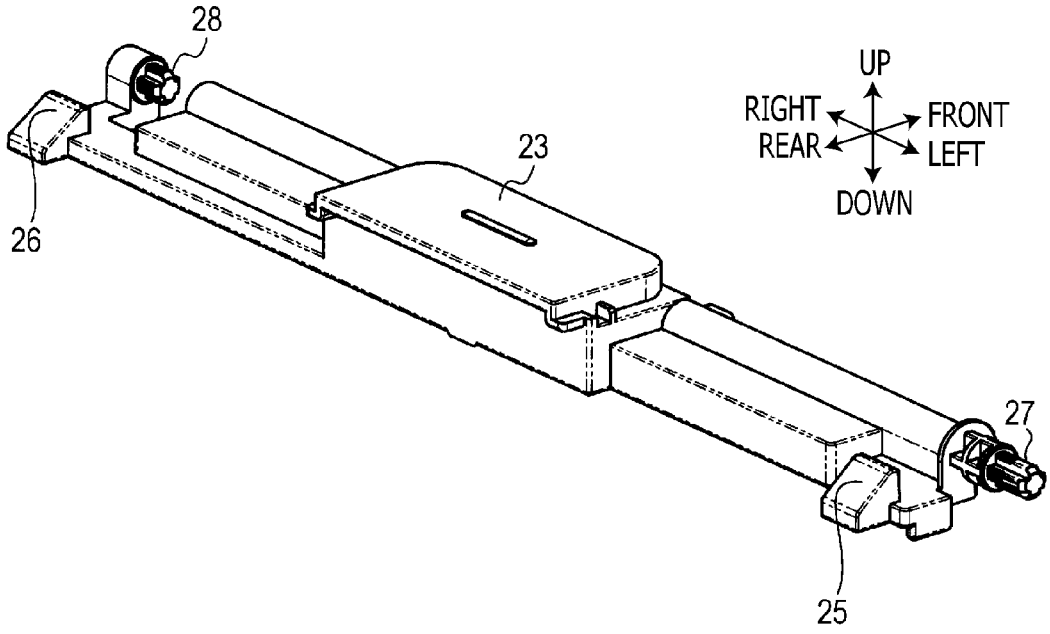
FIG. 3 is a perspective view of an open button.

At the upper edge of the front cover 7, an open button 23 is provided. The open button 23 is a push button to be pressed by a user to open the front cover 7. As shown in FIG. 3, a first stopper portion 25, a second stopper portion 26, and support shafts 27 and 28 are integrally provided with the open button 23.

As shown in FIGS. 4A to 4E, the support shafts 27 and 28 are inserted into bearings 29 and 30, respectively, provided on the front cover 7 side. That is, the open button 23 is rotatably attached to the front cover 7. The open button 23 is in a state of being pressed in a predetermined direction by a pressing force from a spring (not shown). For example, the coil for pressing the open button 23 toward the predetermined direction may be located on the reverse side of the open button 23 such that one end of the spring is hooked to the front cover 7 and the other end of the spring is hooked to a part of the reverse side of the open button 23. In this configuration, when a user presses the open button 23 against the pressing force from the spring, the open button 23 rotates in a direction opposite to the predetermined direction.

As shown in FIGS. 4A to 4E, deep grooves 27A and 28A extending in the axis direction are respectively formed on the outer circumferential surfaces of the support shafts 27 and 28, and shallow grooves 27B and 28B extending in the circumferential direction are respectively formed on the outer circumferential surfaces of the support shafts 27 and 28. With this configuration, a contacting area between the support shaft 27 and the bearing 29 and a contacting area between the support shaft 28 and the bearing 30 can be reduced. Since the contacting area between the support shaft 27 and the bearing 29 and the contacting area between the support shaft 28 and the bearing 30 can be reduced by the above described configuration, the frictional resistance between contacting surfaces of the support shaft 27 and the bearing 29 and the frictional resistance between contacting surfaces of the support shaft 28 and the bearing 30 become small, and thereby the open button 23 can be rotated smoothly. Furthermore, it becomes possible to prevent abnormal noise from being produced at the contacting surfaces.

As shown in FIGS. 5A to 5F, in the image forming device 1, a first receiving portion 32 and a second receiving portion 34 are provided. The first receiving portion 32 constitutes a first locking mechanism 31 with the first stopper portion 25. The second receiving portion 34 constitutes a second locking mechanism 33 with the second stopper portion 26.

As shown in FIG. 2, the first receiving portion 32 and the second receiving portion 34 are arranged in the vicinity of the upper edge portion of the opening 22. When the front cover 7 is moved to the closed position, the first stopper portion 25 and the first receiving portion 32 engage with each other, and the second stopper portion 26 and the second receiving portion 34 engage with each other.

More specifically, regarding the first locking mechanism 31, when the front cover 7 moves from the opened position to the closed position, the first stopper portion 25 contacts the first receiving portion 32 immediately before the front cover 7 reaches the closed position (see FIG. 5A). On the other hand, in the second locking mechanism 33, a slight gap is caused between the second stopper portion 26 and the second receiving portion 34 when the first stopper portion 25 contacts the first receiving portion, although in this case the second stopper portion 26 and the second receiving portion 34 approach with respect to each other (see FIG. 5B).

Therefore, even though the second stopper portion 26 and the second receiving portion 34 may contact with each other due to the tolerance and deformation of components including the front cover 7, the contact pressure between the second stopper portion 26 and the second receiving portion 34 is very small in comparison with the contact pressure between the first stopper portion 25 and the first receiving portion 32 of the first locking mechanism 31.

When the front cover 7 further moves toward the closed position, a force pointing from the first receiving portion 32 toward the first stopper portion 25 acts on the first stopper portion 25, and the force causes the first stopper portion 25 (i.e., the open button 23) to rotate downward as shown in FIG. 5C. As a result, the first stopper portion 25 which rotates together with the open button 23 passes over the first receiving portion 32.

At this time, in the second locking mechanism 33, the second stopper portion 26 rotates with the rotational movement of the open button 23. Therefore, as shown in FIG. 5D, the second stopper portion 26 passes over the second receiving portion 34.

That is, in the first locking mechanism 31, the first stopper portion 25 rotates since the force is applied from the first receiving portion 32 to the first stopper portion 25. On the other hand, in the second locking mechanism 33, the second stopper portion 26 rotates in connection with the rotational movement of the open button 23 regardless of the fact that no force is applied from the second receiving portion 34 to the second stopper portion 26.

Therefore, a resistance force which acts against the pressing force for pressing the front cover 7 toward the closed position becomes relatively large on the first locking mechanism 31 side on the front cover 7 in comparison with the resistance force caused on the second locking mechanism 33 side on the front cover 7.

When the front cover 7 reaches the closed position, the first stopper portion 25 engages with the first receiving portion 32 as shown in FIG. 5E, and thereby the first locking mechanism 31 reaches the locked state. At this time, in the second locking mechanism 33, the second stopper portion 26 engages with the second receiving portion 34 as shown in FIG. 5F, and thereby the second locking mechanism 34 reaches the locked state.

The first and second locking mechanism 31 and 33 are designed such that, in the locked state, a gap formed between the second stopper portion 26 and the second receiving portion 34 is larger than a gap formed between the first stopper portion 25 and the receiving portion 32. Such a configuration makes it possible to set a resistance force which is caused on the second locking mechanism 33 side when the second locking mechanism 33 is brought to the locked state to be smaller than a resistance force which is caused on the first locking mechanism 31 side when the first locking mechanism 31 is brought to the locked state.

With this configuration, it becomes possible to prevent occurrence of a one-sided closed state where the second locking mechanism 33 is not in the locked state regardless of the fact that the first locking mechanism 31 is in the locked state.

In order to move the front cover 7 from the closed position to the opened position, the user presses the open button 23. As a result, the first stopper portion 25 and the second stopper portion 26 rotate together with movement of the open button 23, and the locked states of the first and second locking mechanisms 31 and 33 are released. In this state, the user is able to move the front cover 7 to the opened position by drawing the upper edge portion of the front cover 7 frontward.

Hereafter, third and fourth locking mechanisms are explained. As shown in FIG. 6A, on the left edge side on the front face of the image forming device 1, a third locking mechanism 40 is provided, The third locking mechanism 40 includes a third stopper portion 41 provided on the front cover 7, and a third receiving portion 43 provided on the left side of the housing 3. The third receiving portion 43 is in the state of being pressed upward by an elastic force from a compression spring 45.

As shown in FIG. 6B, in the state where the front cover 7 has moved to the closed position, the third stopper portion 41 and the third receiving portion 43 engage with each other (i.e., in the locked state), so that the front cover 7 is prevented from moving toward the opened position.

In the vicinity of the third locking mechanism 40, a limit switch 47 is provided. The limit switch 47 is arranged such that, in the state where the front cover 7 has moved from the opened position to the closed position, a projection 49 formed to protrude from the front cover 7 contacts a lever 47A of the limit switch 7 and the limit switch 7 switches from ON to OFF. On the other hand, when the front cover 7 moves from the closed position to the opened position, the projection 49 is detached from the lever 47A, and the limit switch 7 switches from OFF to ON. Therefore, it is possible to detect whether the front cover 7 is in the closed position by detecting whether the limit switch 7 is ON or OFF.

As shown in FIG. 7A, on a right edge side on the front face of the image forming device 1, a fourth locking mechanism 50 is provided. The fourth locking mechanism 50 has substantially the same configuration as that of the third locking mechanism 40.

That is, the fourth locking mechanism 50 includes a fourth stopper portion 51 provided on the front cover 7, and a fourth receiving portion 53 provided on the right side on the housing 3. The fourth receiving portion 53 is in the state of being pressed upward by an elastic force from a compression spring 55.

As shown in FIG. 7B, in the state where the front cover 7 has moved to the closed position, the fourth stopper portion 51 and the fourth receiving portion 53 engage with each other (i.e., in the locked state), so that the front cover 7 is prevented from moving toward the opened position.

However, the fourth stopper portion 51 of the fourth locking mechanism 50 is formed to be slightly different from the third stopper portion 41 of the third locking mechanism 40. Due to the difference in shape between the fourth stopper portion 51 and the third stopper portion 41, the fourth locking mechanism 50 requires a stronger force for bringing the fourth stopper portion 51 to the state of being locked with the fourth receiving portion 53 than a force for bringing the third stopper portion 41 to the state of being locked with the third receiving portion 43.

More specifically, as shown in FIG. 8A, when the front cover 7 moves from the opened position to the closed position, the third stopper portion 41 of the third locking mechanism 40 first moves in a traveling direction D1 (which is substantially horizontal when the third stopper portion 41 contacts the third receiving portion 43), and contacts the third receiving portion 43 at a contact start point 41A.

Then, as the third stopper portion 41 moves further in the traveling direction D1, the third stopper portion 41 and the third receiving portion 43 slide with respect to each other while keeping the state of contacting with each other. As a result, a contacting point defined on the third receiving portion 43 between the third stopper portion 41 and the third receiving portion 43 moves along a first guide surface 41B from the contact start point 41A to a peak point 41C.

Next, as the third stopper portion 41 moves further in the traveling direction D1, the third stopper portion 41 and the third receiving portion 43 slide with respect to each other while keeping the state of contacting with each other. As a result, the contacting point defined on the third receiving portion 43 between the third stopper portion 41 and the third receiving portion 43 passes over the peak point 41C, and further moves along a second guide surface 41D from the peak point 41C to an engagement completion point 41E. When the contacting point between the third stopper portion 41 and the third receiving portion 43 reaches the engagement completion point 41E, the third stopper portion 41 and the third receiving portion 43 are brought to the locked state (see FIG. 8B).

Regarding the third stopper portion 41, the first guide surface 41B is formed such that an angle θ1 formed between the first guide surface 41B and the traveling direction D1 (which is substantially horizontal when the third stopper portion 41 contacts the third receiving portion 43) is relatively small. Therefore, when a force for moving the third stopper portion 41 in the traveling direction D1 is divided into an component force which is horizontal with respect to the first guide surface 41B and a component force which is perpendicular to the first guide surface 41B, almost all of the force acts as the component force which is horizontal with respect to the first guide surface 41B and, therefore the component force which is horizontal with the first guide surface 41B causes the third stopper portion 41 to slide along the first guide surface 41B.

On the other hand, as shown in FIG. 8C, when the front cover 7 moves from the opened position to the closed position, the fourth stopper portion 51 of the fourth locking mechanism 50 first moves in the traveling direction D1 (which is substantially horizontal when the fourth stopper portion 51 contacts the fourth receiving portion 53), and contacts the fourth receiving portion 53 at a contact start point 51A.

Then, as the fourth stopper portion 51 moves further in the traveling direction D1, the fourth stopper portion 51 and the fourth receiving portion 53 slide with respect to each other while keeping the state of contacting with each other. As a result, a contacting point defined on the fourth receiving portion 53 between the fourth stopper portion 51 and the fourth receiving portion 53 moves along a first guide surface 51B from the contact start point 51A to a peak point 51C.

Next, as the fourth stopper portion 51 moves further in the traveling direction D1, the fourth stopper portion 51 and the fourth receiving portion 53 slide with respect to each other while keeping the state of contacting with each other. As a result, the contacting point defined on the fourth receiving portion 53 between the fourth stopper portion 51 and the fourth receiving portion 53 passes over the peak point 51C, and further moves along a second guide surface 51D from the peak point 51C to an engagement completion point 51E. When the contacting point between the fourth stopper portion 51 and the fourth receiving portion 53 reaches the engagement completion point 51E, the fourth stopper portion 51 and the fourth receiving portion 53 are brought to the locked state (see FIG. 8D).

Regarding the fourth stopper portion 51, the first guide surface 51B is formed such that an angle θ2 formed between the first guide surface 51B and the traveling direction D1 (which is substantially horizontal when the fourth stopper portion 51 contacts the fourth receiving portion 53) is larger than the angle θ1.

Therefore, when a force for moving the fourth stopper portion 51 in the traveling direction D1 is divided into a component force which is parallel with the first guide surface 51B and a component force which is perpendicular to the first guide surface 51B, the component force acting in parallel with the first guide surface 51B on the fourth stopper portion 51 is smaller than the component force acting in parallel with the first guide surface 41B on the third stopper portion 41.

Therefore, the force for causing the fourth stopper portion 51 to slide along the first guide surface 51B becomes smaller than the force for causing the third stopper portion 41 to slide along the first guide surface 41B. In addition, since the component force which is perpendicular to the first guide surface 51B becomes larger than the component force which is perpendicular to the first guide surface 41B in the case of the third stopper portion 41, the fourth stopper portion 51 is pressed against the first guide surface 51B more strongly in comparison with the case where the third stopper portion 41 is pressed against the first guide surface 41B. That is, a frictional resistance acting between the fourth stopper portion 51 and the first guide surface 51B becomes larger than a frictional resistance acting between the third stopper portion 41 and the first guide surface 41B.

Therefore, in the state where the stopper portions 41 and 51 respectively contact the receiving portions 43 and 53, the third stopper portion 41 can be pushed toward the closed position with a force which is weaker than that for pushing the fourth stopper portion 51 toward the closed position. In other words, in order to bring the fourth locking mechanism 50 into a locked state, it is necessary to apply, to the fourth locking mechanism 50, a stronger external force than an external force for bringing the third locking mechanism 40 into a locked state.

The fourth stopper portion 51 is formed such that a distance between the contact start point 51A and the peak pint 51C is shorter than a distance between the contact start point 41A and the peak point 41C of the third stopper portion 41. Therefore, the fourth stopper portion 51 can be moved such that the contacting point defined on the fourth receiving portion 53 passes over the peak point 51C and reaches the second guide surface 51D without the need for moving the fourth stopper portion 51 to a relatively deep position, although, in order to bring the fourth locking mechanism 50 to the locked state, it is necessary to apply, to the fourth locking mechanism 50, a stronger force than a force for bringing the third locking mechanism 40 to the locked state.

Regarding the fourth stopper portion 51, the second guide surface 51D is formed such that a pressing force acting on the fourth stopper portion 51 when the fourth stopper portion 51 is pressed upward from the fourth receiving portion 53 also acts as a drawing force for drawing the fourth stopper portion 51 toward the closed position. Therefore, when the fourth stopper portion 51 is pressed toward the closed position, the front cover 7 can be drawn to the closed position without applying a strong force to the fourth stopper portion 51 after the contacting point between the fourth stopper portion 51 and the fourth receiving portion 53 passes over the peak point 51C.

In this point of view, regarding the third stopper portion 41, the distance between the contact start point 41A and the peak point 41C is longer than the distance between the contact start point 51A to the peak point 51C. Therefore, it is necessary to press the third stopper portion 41 to a relatively deep point in order to cause the third receiving portion 43 to pass over the peak point 41C. In other words, if the third stopper portion 41 is not pressed to a relatively deep point, the third locking mechanism 40 cannot be brought to the locked state.

Furthermore, after the contacting point between the third stopper portion 41 and the third receiving portion 43 passes over the peak point 41C, the contacting point between the third stopper portion 41 and the third receiving portion 43 reaches the engagement completion point 41E by slightly pressing the third stopper portion 41. For this reason, the drawing force for drawing the third stopper portion 41 toward the closed position is not as strong as that for drawing the fourth stopper portion 51 toward the closed position.

That is, although initially the third stopper portion 41 can be pressed easily in comparison with the fourth stopper portion 51, the third stopper portion 41 is not drawn by the drawing force toward the closed position in comparison with the case of the fourth stopper portion 51. On the other hand, initially the fourth stopper portion 51 is hard to press toward the closed position, but afterward the fourth stopper portion 51 becomes easier to be drawn to the closed position in comparison with case of the third stopper portion 41.

In addition, the front cover 7 is configured such that the flexural rigidity in a left and right direction is relatively low. Therefore, in a state where the third stopper portion 41 is easily to be pressed and the fourth stopper portion 51 is hard to be pressed, the cover deforms, for example, when the front cover 7 is moved to the closed position by pressing the left edge portion of the front cover 7. In this case, the front cover 7 deforms as indicated by a dashed line in FIG. 9.

If the front cover 7 deforms as described above, an elastic restoring force is caused on the front cover 7 depending on the elastic deformation of the front cover 7. The elastic restoring force acts in a direction of drawing back the third stopper portion 41 from the closed position. Therefore, through the elastic restoring force, it becomes possible to prevent the front cover 7 from being closed in a one-sided closed state.

Furthermore, as shown in FIGS. 10A and 10B, regarding the third stopper portion 41 and the third receiving portion 43, when the third stopper portion 41 moves straight in the proper traveling direction D1, a peak part 41P of the third stopper portion 41 and a peak part 43P of the third receiving portion 43 become parallel with each other, and in this case the third stopper portion 41 and the third receiving portion 43 engage with each other after the peak parts 41P and 43P climb over with respect to each other.

By contrast, as shown in FIGS. 10C and 10D, when the third stopper portion 41 moves in an inclined direction D2 with respect to the proper traveling direction D1, the peak parts 41P and 43P become to a state where the peak parts 41P and 43P are not parallel with each other. Therefore, the peak parts 41P and 43P become unable to pass over with respect to each other. In this case, the third stopper portion 41 and the third receiving portion 43 cannot be moved to the position where the third stopper portion 41 and the third receiving portion 43 engage with each other. Such a configuration of the third stopper portion 41 also contributes to preventing the front cover 7 from being closed in a one-sided closed state.

When we make a comparison between the first, second, third and fourth locking mechanisms 31, 33, 40 and 50, it is hardest to bring the third locking mechanism 40 to the locked state. When a condition for bringing the third locking mechanism 40 to the locked state is satisfied, the fourth locking mechanism 50 becomes the locked state accordingly. Furthermore, when the condition for bringing the third locking mechanism 40 to the locked state is satisfied, the first locking mechanism 31 is also brought to the locked state, and thereby the second locking mechanism 33 is brought to the locked state accordingly.

As described above, there is a possibility that, if the front cover 7 is deformed, an upper right portion of the front cover 7 is not brought to the closed position regardless of the fact that an upper left portion of the front cover 7 has been moved to the closed position. However, according to the embodiment, even when such a situation occurs, the third locking mechanism 40 is prevented from being brought to the locked state by an elastic restoring force of the front cover 7.

Therefore, thanks to the elastic restoring force, it becomes possible to prevent occurrence of a situation where only the third locking mechanism 40 is brought to the locked state. That is, the embodiment ensures that when the third locking mechanism 40 is in the locked state, the fourth locking mechanism 31 is also in the locked state.

After the front cover 7 has moved to the closed position side to the extent that the third and fourth locking mechanism 40 and 50 are brought to the locked state, the first and second locking mechanism 31 and 33 are also in the locked state. In this regard, it is easier to bring the second locking mechanism 33 to the locked state in comparison with the first locking mechanism 31.

Such a configuration ensures that the situation where the second locking mechanism 33 is not in the locked state regardless of the fact that the first locking mechanism 31 is in the locked state hardly occurs. Therefore, it becomes also possible to ensure that the situation where the upper right portion of the front cover 7 does not reach the closed position regardless of the fact that the upper left portion of the front cover 7 reaches the position in the vicinity of the closed position hardly occurs.

In other words, regarding the first and second locking mechanism 31 and 33, the second locking mechanism 33 which is father from the limit switch 47 than the first locking mechanism 31 is easy to be brought to the locked state relative to the first locking mechanism 31. Regarding the third and fourth locking mechanism 40 and 50, the third locking mechanism 40 which is closer to the limit switch 47 than the fourth locking mechanism 50 is hard to be brought to the locked state relative to the fourth locking mechanism 50.

Therefore, when the first locking mechanism 31 (which is closer to the limit switch 47 than the second locking mechanism 33) and the third locking mechanism 40 (which is closer to the limit switch 47 than the fourth locking mechanism 50) are in the locked state, it can be expected that the second locking mechanism 33 (which are easier to be brought to the locked state) and the fourth locking mechanism 50 are in the locked state.

Therefore, if the limit switch 47 is able to detect whether the front cover 7 has moved to the position where the first and third locking mechanism 31 and 40 are in the locked state, the limit switch 47 is not required to detect whether the front cover 7 has moved to the position where the second locking mechanism 33 and the fourth locking mechanism 50 are in the locked state.

Such a configuration eliminates the need for employing separate detectors respectively used for detecting whether the front cover 7 has moved to the position where the first and third locking mechanisms 31 and 40 are in the locked state and used for detecting whether the front cover 7 has moved to the position where the second and fourth locking mechanisms 33 and 50 are in the locked state.

Furthermore, such a configuration makes it possible to prevent occurrence of the situation where only the first and third locking mechanisms 31 and 40 are in the locked state but the second and fourth locking mechanism 33 and 50 are not in the locked state. That is, it is possible to prevent the image forming device 1 from erroneously detecting the front cover 7 has b moved to the closed position.

Although the present invention has been described in considerable detail with reference to certain preferred embodiments thereof, other embodiments are possible.

In the above described embodiment, the image forming device 1 is described as an example of an image forming device configured to form an image through an electrophotographic process and to have a housing in which an opening is formed. However, the feature of the above described embodiment may be applied to various types of image processing devices, such as an image reading device provided with, in a housing, a reading unit configured to read an image from a document, and a multifunction-type image processing device provided with both of a reading unit and an image formation unit in a housing.

In the above described embodiment, the first and second stopper portions 25 and 26 are provided on the front cover 7 and the first and second receiving portions 32 and 34 are provided on the housing 3. However, the first and second stopper portions 25 and 26 may be provided on the housing 3 and the first and second receiving portions 32 and 34 may be provided on the front cover 7.

What is claimed is:

1. A cover opening and closing mechanism, comprising:

a housing comprising an opening;

a cover that is attached to the housing to be rotatable about a predetermined rotation axis so that the cover is movable between a closed position and an opened position;

a first locking mechanism comprising a first stopper portion provided at one of a first position on the cover and a corresponding position on the housing and a first receiving portion provided at the other of the first position on the cover and the corresponding position on the housing, the first stopper portion and the first receiving portion being brought to a locked state when the cover is in the closed position;

a second locking mechanism comprising a second stopper portion provided at one of a second position on the cover and a corresponding position on the housing and a second receiving portion provided at the other of the second position on the cover and the corresponding position on the housing, the second stopper portion and the second receiving portion being brought to a locked state when the cover is in the closed position; and a detection unit configured to detect whether the first locking mechanism is in the locked state and not detect whether the second locking mechanism is in the locked state, the detection unit being located at a position which is closer to the first locking mechanism than the second locking mechanism, wherein the first stopper portion and the second stopper portion are provided at respective ends of a member without another stopper portion being disposed between the first and second stopper portions, the member extending in a direction parallel to the rotation axis of the cover, wherein the first position and the second position are at contralateral ends of the cover, along an axis direction of the rotation axis, respectively, wherein:

when the cover is moved to the closed position, the first stopper portion and the first receiving portion move with respect to each other in a first direction and make contact with each other, and then move with respect to each other in a second direction intersecting with the first direction, and thereafter the first stopper portion and the first receiving portion are brought to the locked state after the first stopper portion passes over the first receiving portion; and the second locking mechanism is configured such that the second stopper portion moves in the second direction in connection with movement of the first stopper portion in the second direction so that the second stopper portion and the second receiving portion are brought to the locked state when the first stopper portion and the first receiving portion are brought to the locked state, wherein, when the cover is moved to the closed position, the second stopper portion moves in the second direction in connection with movement of the first stopper portion in the second direction and reaches a position where the second stopper portion does not contact the second receiving portion, and then the second stopper portion and the second receiving portion move with respect to each other in the first direction while maintaining a state where the second stopper portion does not contact the second receiving portion, and thereafter the second stopper portion and the second receiving portion are brought to the locked state by further moving in the second direction in connection with movement of the first stopper portion in the second direction, wherein:

a resistance force acting against movement of the cover to the closed position on a side of the first locking mechanism is larger than a resistance force acting against movement of the cover to the closed position on a side of the second locking mechanism;

the first locking mechanism is configured such that a gap is secured between the first stopper portion and the first receiving portion in the first direction in the locked state of the first locking mechanism;

the second locking mechanism is configured such that a gap is secured between the second stopper portion and the second receiving portion in the first direction in the locked state of the second locking mechanism; and the gap formed between the second stopper portion and the second receiving portion is larger than the gap formed between the first stopper portion and the first receiving portion.

2. The cover opening and closing mechanism according to claim 1, wherein the member is a single member on which the first stopper portion and the second stopper portion are formed so that the second stopper portion moves in connection with movement of the first stopper portion.

3. The cover opening and closing mechanism according to claim 1, wherein the cover is formed to have flexibility and to be deformed when receiving an external force, the cover opening and closing mechanism further comprising:

a third locking mechanism comprising a pair of members respectively provided at a third position on the cover and at a corresponding position on the housing, the pair of members of the third locking mechanism being brought to a locked state when the cover is in the closed position; and a fourth locking mechanism comprising a pair of members respectively provided at a fourth position on the cover and at a corresponding position on the housing, the pair of members of the fourth locking mechanism being brought to a locked state when the cover is in the closed position, wherein a first distance by which the pair of members of the third locking mechanism slide and move with respect to each other in order to bring the third locking mechanism to the locked state is longer than a second distance by which the pair of members of the fourth locking mechanism slide and move with respect to each other in order to bring the fourth locking mechanism to the locked state, and wherein an external force for causing the pair of the members of the third locking mechanism to slide and move with respect to each other is weaker than an external force for causing the pair of members of the fourth locking mechanism to slide and move with respect to each other.

4. The cover opening and closing mechanism according to claim 3, wherein:

at least one of the pair of members of the third locking mechanism is provided with a first guide surface along which the pair of members of the third locking mechanism slide and move with respect to each other;

at least one of the pair of members of the fourth locking mechanism is provided with a second guide surface along which the pair of members of the fourth locking mechanism slide and move with respect to each other; and a first angle that the first guide surface forms with respect to a direction in which the pair of members of the third locking mechanism move with respect to each other when the pair of members of the third locking mechanism make contact with each other is smaller than a second angle that the second guide surface forms with respect to a direction in which the pair of members of the fourth locking mechanism move with respect to each other when the pair of members of the fourth locking mechanism make contact with each other.

5. The cover opening and closing mechanism according to claim 3, wherein:

the cover is elastically deformed when receiving an external force acting such that the third locking mechanism is brought to the locked state in a condition where the fourth locking mechanism is not in the locked state; and the cover produces an elastic restoring force when the cover is elastically deformed, the elastic restoring force acting to prevent the third locking mechanism from being brought to the locked state in the condition where the fourth locking mechanism is not in the locked state.

6. The cover opening and closing mechanism according to claim 3, wherein:

the pair of members of the third locking mechanism includes a third stopper portion provided at one of the third position on the cover and the corresponding position on the housing and a third receiving portion provided at the other of the third position on the cover and the corresponding position on the housing;

when the cover is moved to the closed position, the third stopper portion and the third receiving portion move with respect to each other in a third direction and make contact with each other, and then move with respect to each other in a fourth direction by the first distance, and thereafter the third stopper portion and the third receiving portion are brought to the locked state after passing over, with respect to each other, a peak part formed on at least one of the third stopper portion and the third receiving portion;

the pair of members of the fourth locking mechanism includes a fourth stopper portion provided at one of the fourth position on the cover and the corresponding position on the housing and a fourth receiving portion provided at the other of the fourth position on the cover and the corresponding position on the housing;

when the cover is moved to the closed position, the fourth stopper portion and the fourth receiving portion move with respect to each other in a fifth direction and make contact with each other, and then move with respect to each other in a sixth direction by the second distance, and thereafter the fourth stopper portion and the fourth receiving portion are brought to the locked state after passing over, with respect to each other, a peak part formed on at least one of the fourth stopper portion and the fourth receiving portion.

7. The cover opening and closing mechanism according to claim 6, wherein:

the third stopper portion and the third receiving portion of the third locking mechanism are respectively provided with peak parts formed to be in parallel with each other, when the cover is moved in a direction of bringing the third locking mechanism to the locked state in a condition where the fourth locking mechanism is not in the locked state, the peak parts are brought from a state where the peak parts of the cover and the housing are parallel with each other to a state where the peak parts are not parallel with each other so that the third stopper portion and the third receiving portion become unable to pass over with respect to each other.

8. The cover opening and closing mechanism according to claim 6, wherein:

the third stopper portion and the third receiving portion of the third locking mechanism are configured to be brought to the locked state after the third stopper portion and the third receiving portion pass over, with respect to each other, the peak part and then slide and move with respect to each other in a state of being in contact with each other;

in a state where the third stopper portion and the third receiving portion slide and move with respect to each other in the state of being in contact with each other after the third stopper portion and the third receiving portion pass over the peak part with respect to each other, a first elastic restoring force is caused by an elastic deformation of at least one of the third stopper portion and the third receiving portion, the fourth stopper portion and the fourth receiving portion of the fourth locking mechanism are configured to be brought to the locked state after the fourth stopper portion and the fourth receiving portion pass over, with respect to each other, the peak part and then slide and move with respect to each other in a state of being in contact with each other;

in a state where the fourth stopper portion and the fourth receiving portion slide and move with respect to each other in the state of being in contact with each other after the fourth stopper portion and the fourth receiving portion pass over the peak part with respect to each other, a second elastic restoring force is caused by an elastic deformation of at least one of the fourth stopper portion and the fourth receiving portion;

a force which is caused in accordance with the second restoring force for bringing the fourth stopper portion and the fourth receiving portion to the locked state is stronger than a force which is caused in accordance with the first restoring force for bringing the third stopper portion and the third receiving portion to the locked state.

9. The cover opening and closing mechanism according to claim 8, wherein a distance by which the fourth stopper portion and the fourth receiving portion slide and move with respect to each other after passing over the peak part of at least one of the fourth stopper portion and the fourth receiving portion is longer than a distance by which the third stopper portion and the third receiving portion slide and move with respect to each other after passing over the peak part of at least one of the third stopper portion and the third receiving portion.

10. An image processing device, comprising:

an image processing unit; and a housing comprising an opening;

a cover that is attached to the housing to be rotatable about a predetermined rotation axis so that the cover is movable between a closed position and an opened position;

a first locking mechanism comprising a first stopper portion provided at one of a first position on the cover and a corresponding position on the housing and a first receiving portion provided at the other of the first position on the cover and the corresponding position on the housing, the first stopper portion and the first receiving portion being brought to a locked state when the cover is in the closed position; and a second locking mechanism comprising a second stopper portion provided at one of a second position on the cover and a corresponding position on the housing and a second receiving portion provided at the other of the second position on the cover and the corresponding position on the housing, the second stopper portion and the second receiving portion being brought to a locked state when the cover is in the closed position, a detection unit configured to detect whether the first locking mechanism is in the locked state and not detect whether the second locking mechanism is in the locked state, the detection unit being located at a position which is closer to the first locking mechanism than the second locking mechanism, wherein the first stopper portion and the second stopper portion are provided at respective ends of a member without another stopper portion being disposed between the first and second stopper portions, the member extending in a direction parallel to the rotation axis of the cover, wherein the first position and the second position are at contralateral ends of the cover, along an axis direction of the rotating axis, respectively, wherein:

when the cover is moved to the closed position, the first stopper portion and the first receiving portion move with respect to each other in a first direction and make contact with each other, and then move with respect to each other in a second direction intersecting with the first direction, and thereafter the first stopper portion and the first receiving portion are brought to the locked state after the first stopper portion passes over the first receiving portion; and the second locking mechanism is configured such that the second stopper portion moves in the second direction in connection with movement of the first stopper portion in the second direction so that the second stopper portion and the second receiving portion are brought to the locked state when the first stopper portion and the first receiving portion are brought to the locked state, wherein, when the cover is moved to the closed position, the second stopper portion moves in the second direction in connection with movement of the first stopper portion in the second direction and reaches a position where the second stopper portion does not contact the second receiving portion, and then the second stopper portion and the second receiving portion move with respect to each other in the first direction while maintaining a state where the second stopper portion does not contact the second receiving portion, and thereafter the second stopper portion and the second receiving portion are brought to the locked state by further moving in the second direction in connection with movement of the first stopper portion in the second direction, wherein:

a resistance force acting against movement of the cover to the closed position on a side of the first locking mechanism is larger than a resistance force acting against movement of the cover to the closed position on a side of the second locking mechanism;

the first locking mechanism is configured such that a gap is secured between the first stopper portion and the first receiving portion in the first direction in the locked state of the first locking mechanism;

the second locking mechanism is configured such that a gap is secured between the second stopper portion and the second receiving portion in the first direction in the locked state of the second locking mechanism; and the gap formed between the second stopper portion and the second receiving portion is larger than the gap formed between the first stopper portion and the first receiving portion.

11. The image processing device according to claim 10, wherein the member is a single member on which the first stopper portion and the second stopper portion are formed so that the second stopper portion moves in connection with movement of the first stopper portion.

12. The image processing device according to claim 10, wherein the cover is formed to have flexibility and to be deformed when receiving an external force, the cover opening and closing mechanism further comprising:

a third locking mechanism comprising a pair of members respectively provided at a third position on the cover and at a corresponding position on the housing, the pair of members of the third locking mechanism being brought to a locked state when the cover is in the closed position; and a fourth locking mechanism comprising a pair of members respectively provided at a fourth position on the cover and at a corresponding position on the housing, the pair of members of the fourth locking mechanism being brought to a locked state when the cover is in the closed position, wherein a first distance by which the pair of members of the third locking mechanism slide and move with respect to each other in order to bring the third locking mechanism to the locked state is longer than a second distance by which the pair of members of the fourth locking mechanism slide and move with respect to each other in order to bring the fourth locking mechanism to the locked state, and wherein an external force for causing the pair of the members of the third locking mechanism to slide and move with respect to each other is weaker than an external force for causing the pair of members of the fourth locking mechanism to slide and move with respect to each other.

13. The image processing device according to claim 12, wherein:

at least one of the pair of members of the third locking mechanism is provided with a first guide surface along which the pair of members of the third locking mechanism slide and move with respect to each other;

at least one of the pair of members of the fourth locking mechanism is provided with a second guide surface along which the pair of members of the fourth locking mechanism slide and move with respect to each other; and a first angle that the first guide surface forms with respect to a direction in which the pair of members of the third locking mechanism move with respect to each other when the pair of members of the third locking mechanism make contact with each other is smaller than a second angle that the second guide surface forms with respect to a direction in which the pair of members of the fourth locking mechanism move with respect to each other when the pair of members of the fourth locking mechanism make contact with each other.

14. The image processing device according to claim 13, wherein:

the cover is elastically deformed when receiving an external force acting such that the third locking mechanism is brought to the locked state in a condition where the fourth locking mechanism is not in the locked state; and the cover produces an elastic restoring force when the cover is elastically deformed, the elastic restoring force acting to prevent the third locking mechanism from being brought to the locked state in the condition where the fourth locking mechanism is not in the locked state.

* * * * *